US006871420B2

(12) United States Patent
Shikhashvili

(10) Patent No.: US 6,871,420 B2
(45) Date of Patent: Mar. 29, 2005

(54) WATER SHOE

(76) Inventor: George Shikhashvili, app. 27. Sanzona 15, Tbilisi (GE), 380092

( * ) Notice: Subject to any disclaimer, the term of this patent is extended or adjusted under 35 U.S.C. 154(b) by 31 days.

(21) Appl. No.: 10/471,471

(22) PCT Filed: Mar. 6, 2002

(86) PCT No.: PCT/GE02/00002

§ 371 (c)(1),
(2), (4) Date: Sep. 12, 2003

(87) PCT Pub. No.: WO02/074395

PCT Pub. Date: Sep. 26, 2002

(65) Prior Publication Data

US 2004/0074108 A1 Apr. 22, 2004

(30) Foreign Application Priority Data

Mar. 15, 2001 (GE) ..... AP 2001 004215

(51) Int. Cl.[7] ..... A43B 5/08

(52) U.S. Cl. ..... 36/8.1; 36/3 B; 36/3 A; 441/61

(58) Field of Search ..... 36/8.1, 3 B, 3 R, 36/3 A; 441/61, 62, 63, 64

(56) References Cited

U.S. PATENT DOCUMENTS

| | | | | | |
|---|---|---|---|---|---|
| D149,580 | S | * | 5/1948 | Messinger | D21/806 |
| 2,865,033 | A | * | 12/1958 | Jayet | 441/64 |
| 3,605,292 | A | | 9/1971 | Goldblatt | |
| 4,787,871 | A | * | 11/1988 | Tomlinson | 441/61 |
| 5,326,296 | A | | 7/1994 | De Jesus | |
| 5,795,204 | A | | 8/1998 | Bruner | |

FOREIGN PATENT DOCUMENTS

| | | | | | |
|---|---|---|---|---|---|
| DE | 595769 | C | | 4/1934 | |
| DE | 3151650 | A | | 7/1983 | |
| DE | 29604494 | U | | 5/1996 | |
| FR | 2493157 | A | | 5/1982 | |
| JP | 52002995 | A | * | 1/1977 | A63B/31/12 |
| JP | 02 218378 | A | | 8/1990 | |

OTHER PUBLICATIONS

Translation of DE 3151650 listed on PTO–1449.*
Translation of DE 29604494 listed on PTO–1449.*

* cited by examiner

*Primary Examiner*—Ted Kavanaugh
(74) *Attorney, Agent, or Firm*—Gerry J. Elman; Elman Technology Law, P.C.

(57) ABSTRACT

My invention is unification of shoe and swimming enforcing elements comprising water shoe to assure unconstrained and protected walking and promotion for swimming due to generating of additional tractive force in consequence of foot swimming motions. A flexible slip protected spatial internally partitioned sole, with upper reticulated surface and perforated side wall with outlet holes jointly provide free drainage of water and sand from a shoe upper body. For its turn upper body is also reticulated, of flexible hard enough material fixed on the spatial lower sole. Few ranges of swimming elements, angle shaped fins, are immovably fixed on both lateral sides of the shoe upper body in such away that are paralleled to each other and upper body's top surface.

20 Claims, 4 Drawing Sheets

WATER SHOE

TECHNICAL FIELD

My invention relates to light industry, namely to recreational suit and shoe production and concerns to water shoes.

Technical result of my invention is facilitation of walking on beach, improving of swimming dynamic, enforcing of working stroke during swimming due to emerging of additional tractive force, reducing of power input during swimming.

BACKGROUND ART

It is known water shoe (Inventors Bruner; Roderick S., U.S. Pat. No. 5,795,204; Class A63B 031/11, published Aug. 18, 1998) which comprises sole and attached to sole upper body. Direct extension of sole from side wall is flipper shaped flexible swimming element. Indicated shoe is anticipated both for walking on beech and swimming, in which connection the shoe facilitates swimming and reduces the power inputs of swimmer.

The deficiency of indicated shoe is relatively inconveniency when walking on the beach due to flipper shaped flexible swimming element attached to sole. Beside this design of the shoe does not consider the dynamic of swimmer's foot, which tends to turn outside during working stroke of the leg, when such tendency is strengthened due to outer position of the swimming element. (Increasing of pressure on the foot's outer part)

Beside this due to design additional tractive force produced by swimming element during working stroke is not directed along but athwart the foot and hence to swimming direction, that is less promotional.

DISCLOSURE OF INVENTION

The essence of my invention is that the Water Shoe comprises of spatial sole, attached to the sole upper body, and swimming elements, so as the swimming element is angle shaped fin, attached to the upper body and the sole.

The water shoe comprises of spatial sole (1) and attached on it upper body (2). On the sole (1) and upper body's (2) both side surfaces are fixed swimming elements which are angle shaped fins (3).

The fin (3) comprises of stiff console (a) with lateral stiff (b) and flexible, gradually thinning (c) parts.

Fins (3) are motionlessly fixed on upper body (2) both side surfaces and sole (1) by means of stiff console (a) on suitable distance from upper body (2) to prevent contact between a fin flexible part (c) and upper body (2).

Fins (3) are disposed stepwise, are paralleled to each other and to front top surface of upper body (2). At the same time number of fins (3) lateral inside is more then lateral outside of the Water Shoe.

Surface of fins (3) from lateral inside is bigger than fins (3) lateral outside of named Water Shoe.

Reticulated surface of the upper body (2) ensures free drainage of water and improves the aerodynamic characteristic of foot during swimming.

Upper reticulated surface (4) of sole (1) ensures free drainage of water and sand through internally partitioned cavity existing between of the sole (1) top (4) and lower (5) surfaces, when water and sand freely flow out through existing on the sole (1) perforated side wall (7) with outlet holes (6). Everything mentioned excludes "scruple in shoe" effect.

Presence of fins (3) and immovable fixation by means of console (a) of lateral stiff (b) parts on upper body (2) promotes swimming due to production of tractive force by flexible (c) part of fin (3 during working stroke of foot and reduce swimmer's power input.

Stepwise disposition of fins (3) ensures redistribution of water flow to all fins (3) creating the cascade motion of flow excluding shading of each fin (3) taken separately.

Paralleled disposition of fins (3) to each other and to upper body's (2) front top surface ensures athwart position of fins (3) towards direction of foot working stroke, what provides production of maximum tractive force.

Disposition from inside lateral part of Water Shoe bigger quantity and/or bigger summery surface of fins (3) in compression with outside lateral part, insures increasing of ultimate pressure on foot inside part in comparison with foot's outside part, what facilitates dynamic of swimmer foot and suppresses foot's twisting tendency from inside to outside. Such stabilization of swimmers foot on its turn is promotional for additional tractive force production.

SUMMARY OF INVENTION

So invented Water Shoe is comfortable both for walking on the beach and promotional for swimming, increases swimming speed and reduces swimmer's power input what altogether increases swimmer's security.

BRIEF DESCRIPTION OF DRAWINGS

Description of the invention is defined in drawings, where.

BEST MODE FOR CARRYING OUT THE INVENTION

Figure 1:
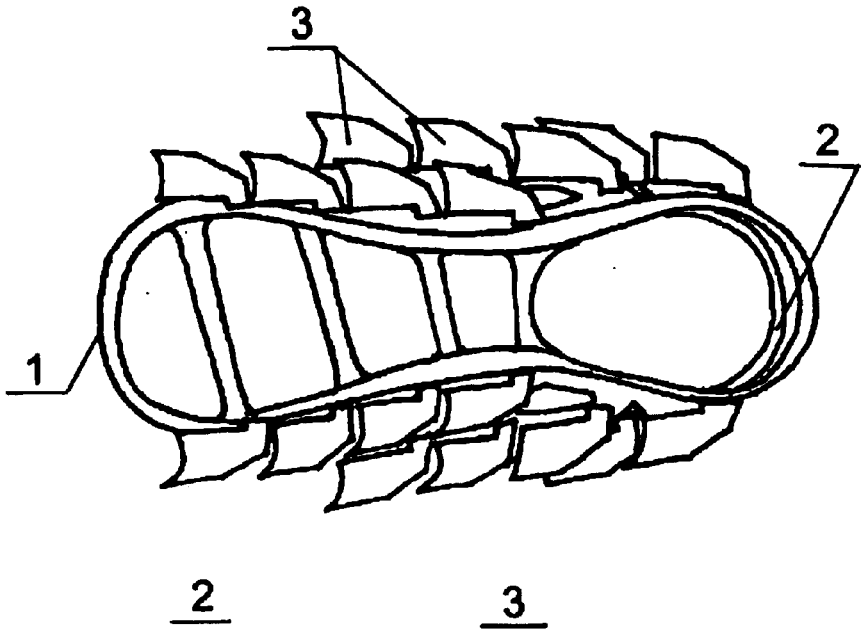
FIG. 1—depicts the view from above Water Shoe.
Figure 2:
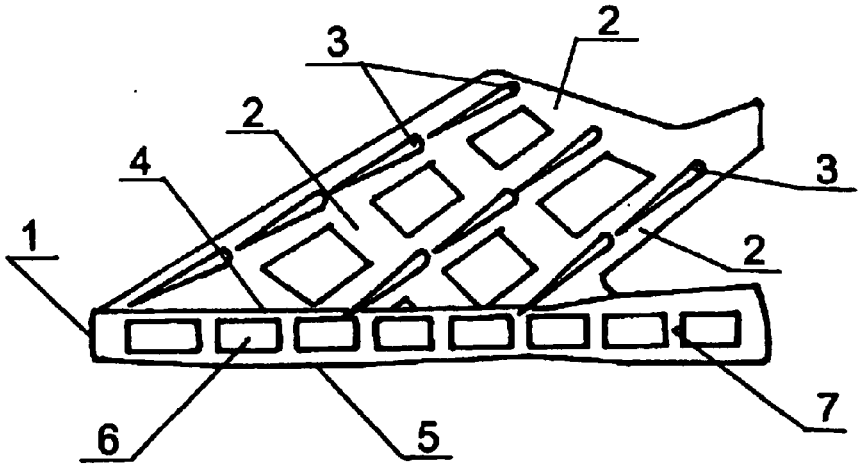
FIG. 2—the same from side view.
Figure 3:
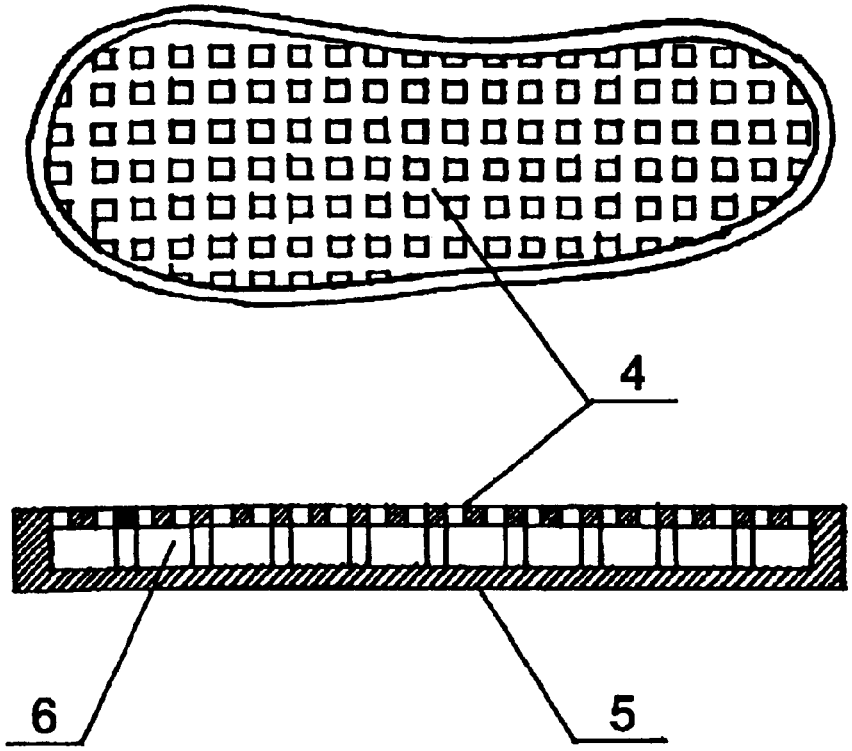
FIG. 3—spatial sole in view from above and from side view.
Figure 4A:
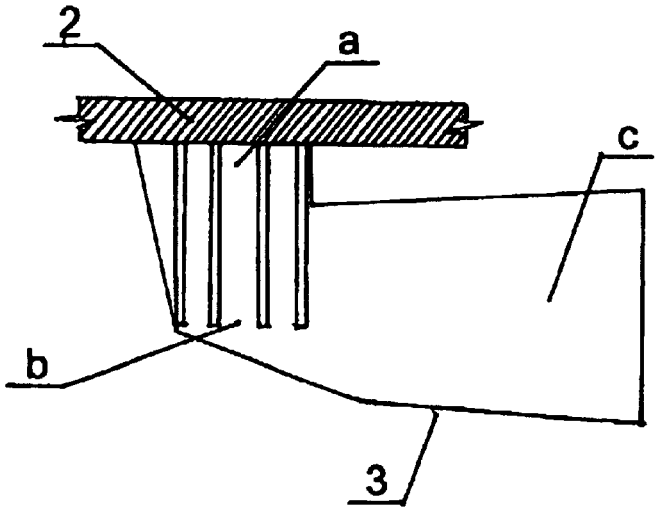
FIG. 4A—fin view from above.
Figure 4B:
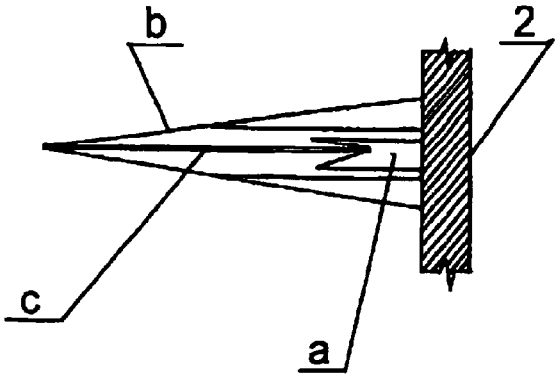
FIG. 4B—from side
Figure 4C:
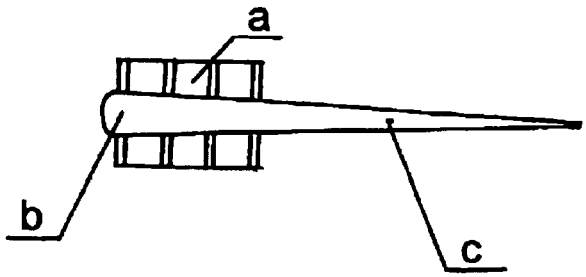
FIG. 4C—front views.
Figure 5:
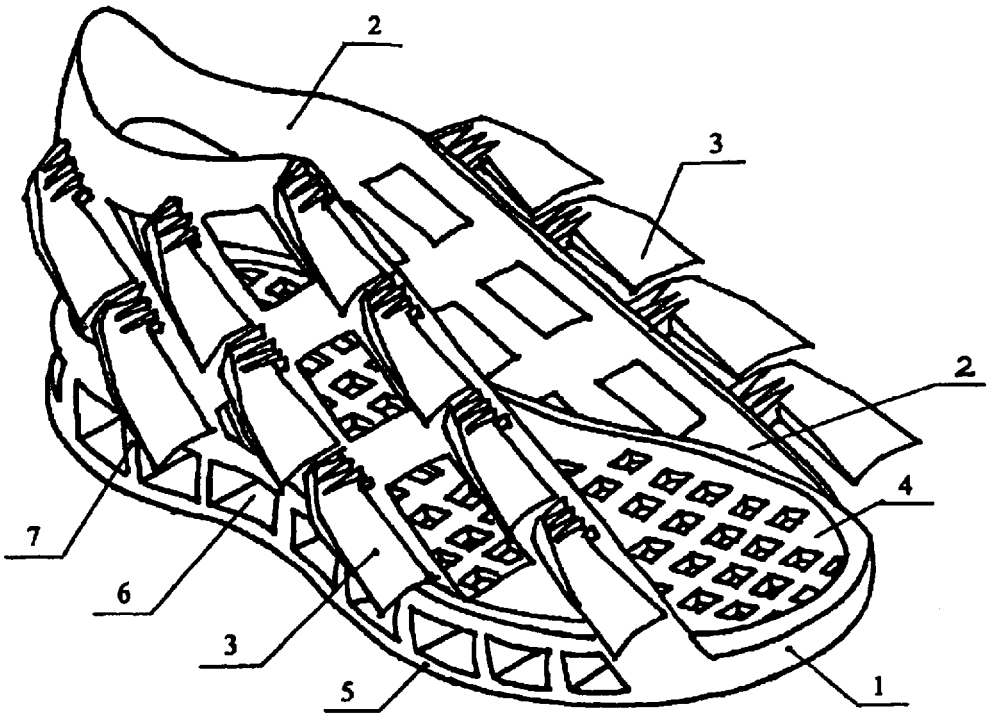
FIG. 5—general view of Water Shoe.

In paramount variant of the Water Shoe implementation the sole (1) and upper body (2) are manufactured of springy hard enough material. Upper body (2) is reticulated.

Spatial sole (1) has upper (4) reticulated and lower with non slip coating (5) and perforated side wall (7) with outlet holes (6), at the same time the space between top (4) and lower (5) surfaces of sole 1 is partitioned.

Swimming element is angle shaped fins. The fin (3) comprises of stiff console (a) with lateral stiff (b) parts, both out of inflexible material, and gradually thinning (c) parts made out of flexible material.

What is claimed is:

1. A water shoe having an outer surface comprising an area towards the inside of the wearer's leg and an area towards the outside of the wearer's leg, the shoe comprising a sole, an upper body, and swimming elements, the swimming elements being a plurality of fins fixed laterally onto the outer surface of the shoe, wherein the total surface area of said fins disposed on said inside area is greater than the total surface area of said fins disposed on said outside area, thereby diminishing the tendency of the foot of the wearer to turn outside during working stroke.

2. The water shoe of claim 1, wherein the fins comprise a stiff console at the proximal end thereof, a lateral stiff part and a gradually thinning flexible part distal thereto.

3. The water shoe of claim 1, wherein the stiff console of each fin is immovably fixed to the shoe, some being fixed to the sole and others being fixed to the upper body.

4. The water shoe of claim 1, wherein the fins are parallel to each other and to the front top surface of the upper body of the shoe.

5. The water shoe of claim 4, wherein the fins have stepwise disposition.

6. The water shoe of claim 1, wherein the fins have stepwise disposition.

7. The water shoe of claim 1, wherein the upper body is reticulated and is made of hard, springy material.

8. The water shoe of claim 1, wherein the sole is a spatial sole having a perforated top surface, a lower surface, a partitioned cavity between the top and lower surfaces, and a side wall having outlet holes.

9. The water shoe of claim 8, wherein the lower surface of the spatial sole has a non-slip coating.

10. The water shoe of claim 1, wherein the sole is made of flexible material.

11. The water shoe of claim 1, wherein the fins have stepwise disposition.

12. A water shoe having an outer surface comprising an area towards the inside of the wearer's leg and an area towards the outside of the wearer's leg, the shoe comprising a sole, an upper body, and swimming elements, the swimming elements being a plurality of fins fixed laterally onto the outer surface of the shoe, wherein the total quantity of said fins disposed on said inside area is greater than the total quantity of said fins disposed on said outside area, thereby diminishing the tendency of the foot of the wearer to rum outside during working stroke.

13. The water shoe of claim 12, wherein the fins comprise a stiff console at the proximal end thereof, a lateral stiff part and a gradually thinning flexible part distal thereto.

14. The water shoe of claim 13, wherein the stiff console of each fin is immovably fixed to the shoe, some being fixed to the sole and others being fixed to the upper body.

15. The water shoe of claim 12, wherein the fins are parallel to each other and to the front top surface of the upper body of the shoe.

16. The water shoe of claim 15, wherein the fins have stepwise disposition.

17. The water shoe of claim 12, wherein the upper body is reticulated and is made of hard, springy material.

18. The water shoe of claim 12, wherein the sole is a spatial sole having a perforated top surface, a lower surface, a partitioned cavity between the top and lower surfaces, and a side wall having outlet holes.

19. The water shoe of claim 18, wherein the lower surface of the spatial sole has a non-slip coating.

20. The water shoe of claim 12, wherein the sole is made of flexible material.

* * * * *